US008599085B2

(12) United States Patent
Buer et al.

(10) Patent No.: US 8,599,085 B2
(45) Date of Patent: Dec. 3, 2013

(54) ELECTROMECHANICAL POLARIZATION SWITCH

(75) Inventors: Kenneth V. Buer, Gilbert, AZ (US); Josh Tor, Gilbert, AZ (US); David Laidig, Mesa, AZ (US)

(73) Assignee: ViaSat, Inc., Carlsbad, CA (US)

( * ) Notice: Subject to any disclaimer, the term of this patent is extended or adjusted under 35 U.S.C. 154(b) by 751 days.

(21) Appl. No.: 12/758,942

(22) Filed: Apr. 13, 2010

(65) Prior Publication Data

US 2011/0109520 A1 May 12, 2011

Related U.S. Application Data

(60) Provisional application No. 61/259,053, filed on Nov. 6, 2009, provisional application No. 61/259,047, filed on Nov. 6, 2009, provisional application No. 61/259,049, filed on Nov. 6, 2009.

(51) Int. Cl.
*H01Q 19/00* (2006.01)

(52) U.S. Cl.
USPC ..... 343/756; 343/772; 333/21 A

(58) Field of Classification Search
USPC ..... 343/756, 772, 876; 333/21 A, 106
See application file for complete search history.

(56) References Cited

U.S. PATENT DOCUMENTS

| | | | | |
|---|---|---|---|---|
| 2,754,483 | A | 7/1956 | Zaleski | |
| 3,740,756 | A | 6/1973 | Sosin | |
| 4,504,805 | A | 3/1985 | Ekelman, Jr. et al. | |
| 4,710,734 | A * | 12/1987 | Sterns | 333/101 |
| 5,122,810 | A * | 6/1992 | Nisbet et al. | 343/756 |
| 5,434,575 | A | 7/1995 | Jelinek et al. | |
| 5,596,336 | A * | 1/1997 | Liu | 343/770 |
| 5,614,874 | A | 3/1997 | McCandless | |
| 6,087,908 | A | 7/2000 | Haller et al. | |
| 6,323,819 | B1 | 11/2001 | Ergene | |
| 6,396,441 | B2 | 5/2002 | Perrott | |
| 6,512,485 | B2 | 1/2003 | Luly | |
| 6,563,398 | B1 | 5/2003 | Wu | |
| 7,043,269 | B2 * | 5/2006 | Ono et al. | 455/558 |
| 7,109,938 | B2 | 9/2006 | Franson | |
| 2002/0171597 | A1 | 11/2002 | Krishmar-Junker | |
| 2002/0175875 | A1 | 11/2002 | Verstraeten | |
| 2003/0067364 | A1 | 4/2003 | Beis et al. | |
| 2004/0183615 | A1 * | 9/2004 | Dybdal | 333/21 A |
| 2005/0259026 | A1 | 11/2005 | Cook | |
| 2007/0075909 | A1 | 4/2007 | Flynn | |
| 2007/0296518 | A1 | 12/2007 | Avramis | |
| 2009/0224990 | A1 | 9/2009 | Cezanne et al. | |
| 2010/0141543 | A1 * | 6/2010 | Parekh et al. | 343/786 |

OTHER PUBLICATIONS

International Search Report and Written Opinion for PCT/US09/63605 dated Sep. 16, 2010.

(Continued)

*Primary Examiner* — Tho G Phan
(74) *Attorney, Agent, or Firm* — Snell & Wilmer LLP

(57) ABSTRACT

In accordance with various aspects of the present invention, a method and system for electro-mechanical polarization switching in an antenna system is presented. The antenna system may comprise an integrated waveguide in a transceiver housing, where the waveguide has at least four channels. In an exemplary embodiment, a sliding switch is incorporated into the waveguide. The sliding switch is configured to switch the polarization of the antenna system by physically realigning the waveguide channels. The sliding switch may be electro-magnetically controlled. Furthermore, the polarization switching may be performed to assist in load balancing for a particular frequency and/or polarization combination.

20 Claims, 9 Drawing Sheets

(56) References Cited

OTHER PUBLICATIONS

International Preliminary Report on Patentability dated May 18, 2012 in Application No. PCT/US2010/030849.
International Search Report and Written Opinion dated Dec. 3, 2010 in PCT Application No. PCT/US10/30849.
International Preliminary Report on Patentability dated May 26, 2011 in PCT Application No. PCT/US09/63605.
Notice of Allowance dated Mar. 15, 2012 in U.S. Appl. No. 12/268,840.
Office Action dated Aug. 1, 2012 in U.S. Appl. No. 13/539,721.
Office Action dated Jan. 5, 2012 in U.S. Appl. No. 12/268,840.
Restriction Requirement dated Aug. 15, 2012 in U.S. Appl. No. 12/614,185.
Office Action dated Nov. 30, 2012 in U.S. Appl. No. 12/614,185.
Notice of Allowance dated Nov. 13, 2012 in U.S. Appl. No. 13/539,721.
Notice of Allowance dated May 1, 2013 in U.S. Appl. No. 12/614,185.
Corrected Notice of Allowance dated May 28, 2013 in U.S. Appl. No. 12/614,185.

* cited by examiner

Distribution Pattern

Practical Distribution Illustration 400
403
410
412
413
414
415
425
435
445
455
411

400

ELECTROMECHANICAL POLARIZATION SWITCH

CROSS REFERENCE TO RELATED APPLICATIONS

This application is a non-provisional of U.S. Provisional Application No. 61/259,053, entitled "ELECTROMECHANICAL POLARIZATION SWITCH," which was filed on Nov. 6, 2009. This application is a non-provisional of U.S. Provisional Application No. 61/259,047, entitled "AUTOMATED BEAM PEAKING SATELLITE GROUND TERMINAL," which was filed on Nov. 6, 2009. This application is a non-provisional of U.S. Provisional Application No. 61/259,049, entitled "DYNAMIC REAL-TIME POLARIZATION FOR ANTENNAS," which was filed on Nov. 6, 2009. All of the contents of the previously identified applications are hereby incorporated by reference for any purpose in their entirety.

FIELD OF THE INVENTION

The subject of this disclosure may relate generally to systems, devices, and methods for an antenna terminal configured for polarization switching to increase system performance.

BACKGROUND OF THE INVENTION

A propagating radio frequency (RF) signal can have different polarizations, namely linear, elliptical, or circular. Linear polarization consists of vertical polarization and horizontal polarization, whereas circular polarization consists of left-hand circular polarization (LHCP) and right-hand circular polarization (RHCP). An antenna is typically configured to pass one polarization, such as LHCP, and reject the other polarization, such as RHCP.

Conventional very small aperture terminal (VSAT) antennas utilize a fixed polarization that is generally hardware dependant. During installation of the satellite terminal, the basis polarization is generally set and the polarizer is fixed in position. Changing this setting generally requires a technician at the terminal to physically manipulate the polarizer.

Unlike a typical single polarization antenna, some devices are configured to change polarizations without disassembling the antenna terminal. As an example and with reference to FIG. 1, a prior embodiment is the use of "baseball" switches 101 to provide electronically commandable switching between polarizations. As can be understood by the block diagram, the rotation of the "baseball" switches 101, by connecting one signal path and terminating the other signal path, cause a change in polarization. A separate rotational actuator with independent control circuitry is generally required for each "baseball" switch 101, which increases the cost of device.

Thus, there is a need for a new low cost method and device for switching polarization of an antenna system that results in low loss and high power performance. Also, there is a need for remote substantially instantaneous switching polarization of an antenna systems.

SUMMARY OF THE INVENTION

In accordance with various aspects of the present invention, a method and system for electro-mechanical polarization switching in an antenna system is presented. The antenna system may comprise an integrated waveguide in a transceiver housing, where the waveguide has at two or more channels. In an exemplary embodiment, a sliding switch is incorporated into the waveguide. The sliding switch is configured to switch the polarization of the antenna system by physically realigning the waveguide channels In accordance with various aspects of the present invention, a method of polarization switching is presented including: (1) operating an antenna system in a first mode having a first polarization; (2) operating the antenna system in a second mode having a second polarization; (3) switching between the first mode and the second mode by physically altering the channels of a waveguide of the antenna system using a linear switch. In this exemplary embodiment, the first polarization is different from the second polarization.

In accordance with an exemplary embodiment, a terrestrial microwave communications terminal is configured to facilitate load balancing. Load balancing involves moving some of the load on a particular satellite, or point-to-point system, from one polarity/frequency range "color" or "beam" to another. The load balancing is enabled by the ability to remotely switch polarity.

In an exemplary embodiment, this signal switching (and therefore this satellite capacity "load balancing") can be performed periodically. In other exemplary embodiments, load balancing can be performed on many terminals (e.g., hundreds or thousands of terminals) simultaneously or substantially simultaneously. In other exemplary embodiments, load balancing can be performed on many terminals without the need for thousands of user terminals to be manually reconfigured.

In an exemplary embodiment, the load balancing is performed as frequently as necessary based on system loading. For example, load balancing could be done on a seasonal basis. For example, loads may change significantly when schools, colleges, and the like start and end their sessions. In an exemplary embodiment, the switching may occur with any regularity. For example, the polarization may be switched during the evening hours, and then switched back during business hours to reflect transmission load variations that occur over time. In an exemplary embodiment, the polarization may be switched thousands of times during the life of the device.

BRIEF DESCRIPTION OF THE DRAWINGS

These and other features, aspects and advantages of the present invention will become better understood with reference to the following description, appending claims, and accompanying drawings where:

DETAILED DESCRIPTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following descriptions are not intended as a limitation on the use or applicability of the invention, but instead, are provided merely to enable a full and complete description of exemplary embodiments.

Figure 1:
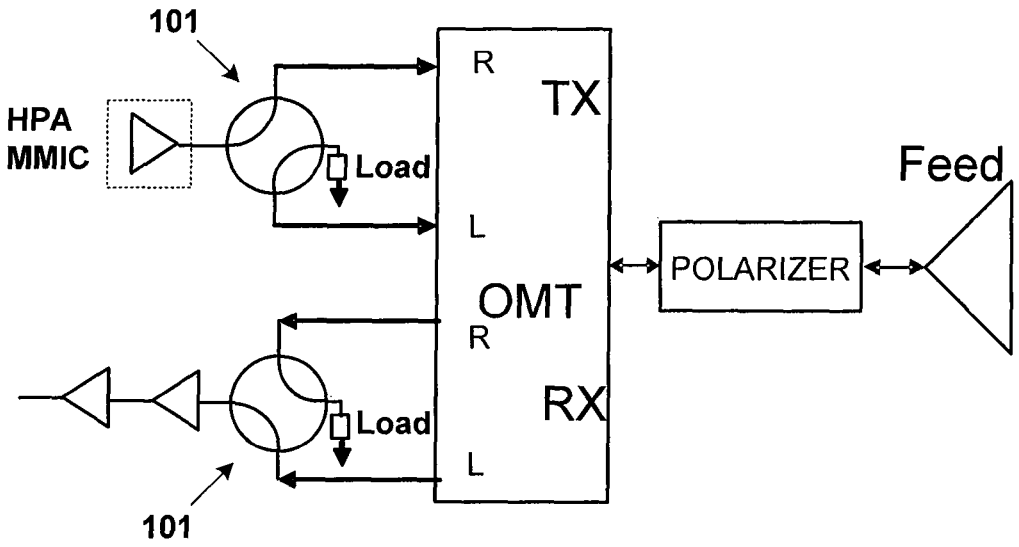
Figure 1 Prior Art
FIG. 1 illustrates a block diagram view of a prior art antenna system with baseball switches.
Figure 2:
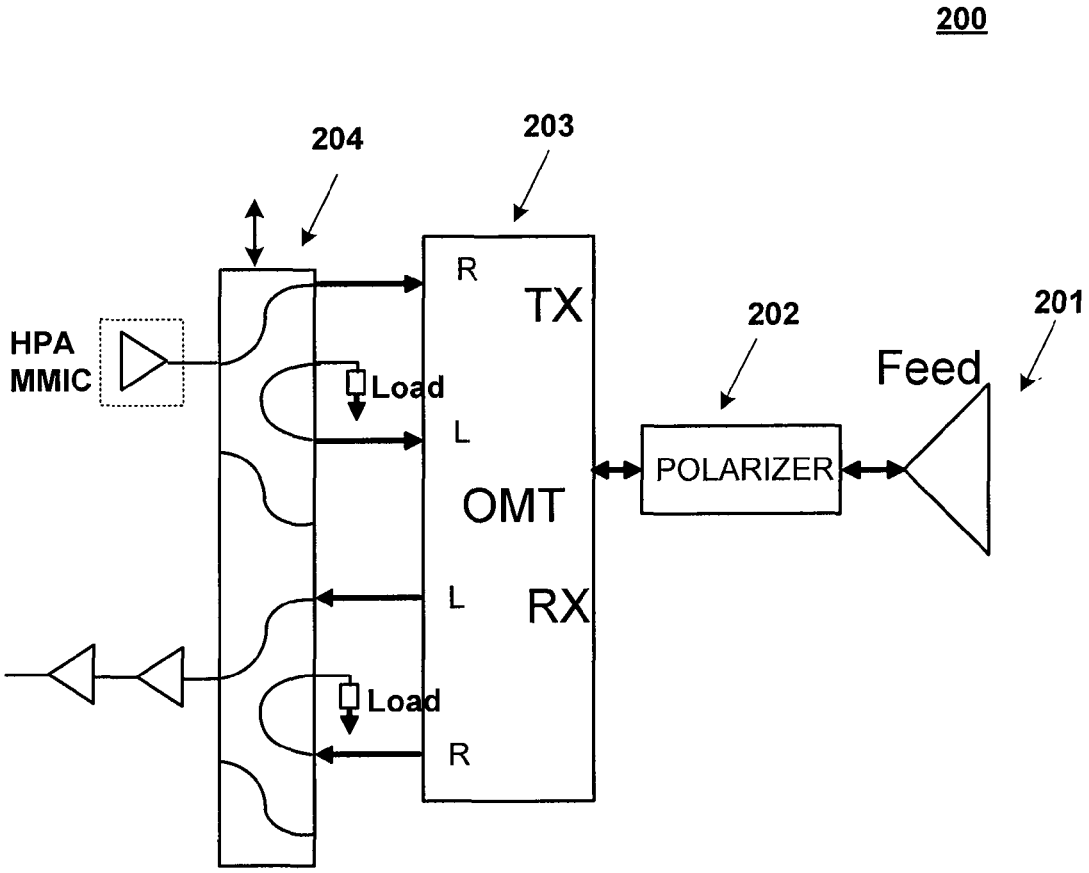
FIG. 2 illustrates a block diagram of an exemplary antenna system with a sliding switch for facilitating polarization switching.

In accordance with an exemplary embodiment, polarization switching devices and methods are disclosed. The polarization switching may be done in conjunction with frequency switching, or it may be done while maintaining the same frequency. Thus, some discussion will follow regarding both polarization and frequency switching, but various embodiment switch only polarization. In an exemplary embodiment, an antenna transceiver is configured to change polarization with minimal interruption of receiving and/or transmitting microwave and mm-wave signals. In an exemplary embodiment and with reference to FIG. 2, an antenna system 200 comprises a feed structure of a feed horn 201, a polarizer 202 and a waveguide 203, plus a sliding switch 204. Sliding switch 204 is configured, in an exemplary embodiment, to reconfigure the polarization of the communicated signals. In one embodiment, waveguide 203 is an orthomode transducer (OMT). Sliding switch 204 is connected to waveguide 203, and positioned between waveguide 203 and a transmitter/receiver portion(s) of antenna system 200. In effect, sliding switch 204 is an extension of waveguide 203 and guides the signals to either be communicated or terminated into a load.

In the field of consumer satellite RF communication, a satellite will typically transmit and/or receive data (e.g., movies and other television programming, internet data, and/or the like) to consumers who have personal satellite dishes at their home. More recently, the satellites may transmit/receive data from more mobile platforms (such as, transceivers attached to airplanes, trains, and/or automobiles). It is anticipated that increased use of handheld or portable satellite transceivers will be the norm in the future. Although sometimes described in this document in connection with home satellite transceivers, the prior art limitations now discussed may be applicable to any personal consumer terrestrial transceivers (or transmitters or receivers) that communicate with a satellite.

A propagating radio frequency (RF) signal can have different polarizations, namely linear, elliptical, or circular. Linear polarization consists of vertical polarization and horizontal polarization, whereas circular polarization consists of left-hand circular polarization (LHCP) and right-hand circular polarization (RHCP). An antenna is typically configured to pass one polarization, such as LHCP, and reject the other polarization, such as RHCP.

Also, conventional very small aperture terminal (VSAT) antennas utilize a fixed polarization that is hardware dependant. The basis polarization is generally set during installation of the satellite terminal, at which point the manual configuration of the polarizer hardware is fixed. For example, a polarizer is generally set for LHCP or RHCP and fastened into position. To change polarization in a conventional VSAT antenna might require unfastening the polarizer, rotating it 90 degrees to the opposite circular polarization, and then refastening the polarizer. Clearly this could not be done with much frequency and only a limited number (on the order of 5 or maybe 10) of transceivers could be switched per technician in a given day.

Unlike a typical single polarization antenna, some devices are configured to change polarizations without disassembling the antenna terminal. As an example, a prior embodiment is the use of "baseball" switches to provide electronically commandable switching between polarizations. The rotation of the "baseball" switches causes a change in polarization by connecting one signal path and terminating the other signal path. However, each "baseball" switch requires a separate rotational actuator with independent control circuitry, which increases the cost of device such that this configuration is not used (if at all) in consumer broadband or VSAT terminals, but is instead used for large ground stations with a limited number of terminals.

Furthermore, another approach is to have a system with duplicate hardware for each polarization. The polarization selection is achieved by completing or enabling the path of the desired signal and deselecting the undesired signal. This approach is often used in terminals, for example satellite television receivers having low-cost hardware. However, with two way terminals that both transmit and receive such as VSAT or broadband terminals, doubling the hardware greatly increases the cost of the terminal.

Conventional satellites may communicate with the terrestrial based transceivers via radio frequency signals at a particular frequency band and a particular polarization. Each combination of a frequency band and polarization is known as a "color". The satellite will transmit to a local geographic area with signals in a "beam" and the geographic area that can access signals on that beam may be represented by "spots" on a map. Each beam/spot will have an associated "color." Thus, beams of different colors will not have the same frequency, the same polarization, or both.

In practice, there is some overlap between adjacent spots, such that at any particular point there may be two, three, or more beams that are "visible" to any one terrestrial transceiver. Adjacent spots will typically have different "colors" to reduce noise/interference from adjacent beams.

In the prior art, broadband consumer satellite transceivers are typically set to one color and left at that setting for the life of the transceiver. Should the color of the signal transmitted from the satellite be changed, all of the terrestrial transceivers that were communicating with that satellite on that color would be immediately stranded or cut off. Typically, a technician would have to visit the consumer's home and manually change out (or possibly physically disassemble and re-assemble) the transceiver or polarizer to make the consumer's terrestrial transceiver once again be able to communicate with the satellite on the new "color" signal. The practical effect of this is that in the prior art, no changes are made to the signal color transmitted from the satellite.

For similar reasons, a second practical limitation is that terrestrial transceivers are typically not changed from one color to another (i.e. if they are changed, it is a manual process). Thus, there is a need for a new low cost method and device to remotely change the frequency and/or polarization of an antenna system. There is also a need for a method and device that may be changed nearly instantaneously and often.

In spot beam communication satellite systems, both frequency and polarization diversity are utilized to reduce interference from adjacent spot beams. In an exemplary embodiment, both frequencies and polarizations are re-used in other beams that are geographically separated to maximize communications traffic capacity. The spot beam patterns are generally identified on a map using different colors to identify the combination of frequency and polarity used in that spot beam. The frequency and polarity re-use pattern is then defined by how many different combinations (or "colors") are used.

Figure 3:
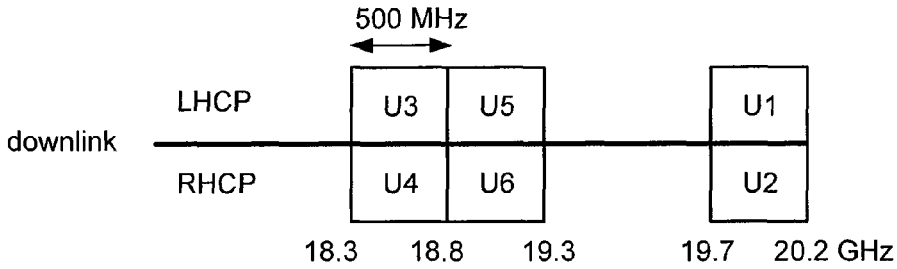
FIG. 3 illustrates an exemplary embodiment of color distribution.
Figure 3:
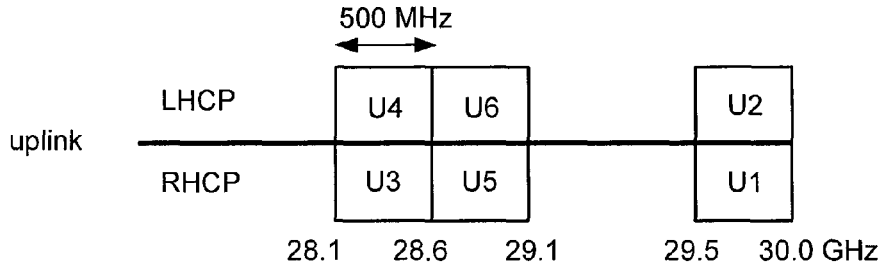
Figure 3:
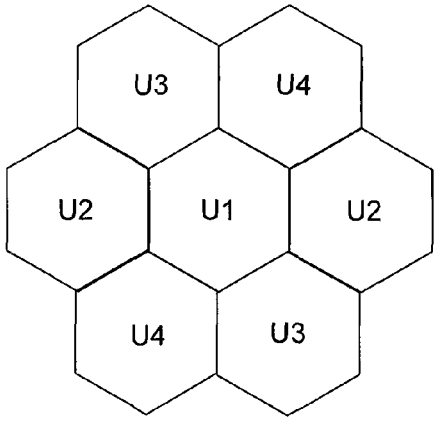
Figure 3:
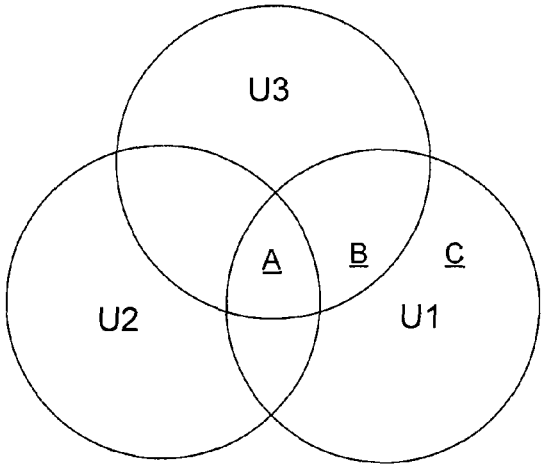

In accordance with various exemplary embodiments and with reference to FIG. 3, an antenna system is configured for frequency and polarization switching. In one specific exemplary embodiment, the frequency and polarization switching comprises switching between two frequency ranges and between two different polarizations. This may be known as four color switching. In other exemplary embodiments, the frequency and polarization switching comprises switching between three frequency ranges and between two different polarizations, for a total of six separate colors. Furthermore, in various exemplary embodiments, the frequency and polarization switching may comprise switching between two polarizations with any suitable number of frequency ranges. In another exemplary embodiment, the frequency and polarization switching may comprise switching between more than two polarizations with any suitable number of frequency ranges.

In accordance with various exemplary embodiments, the ability to perform frequency and polarization switching has many benefits in terrestrial microwave communications terminals. For example, doing so may facilitate increased bandwidth, load shifting, roaming, increased data rate/download speeds, improved overall efficiency of a group of users on the system, or improved individual data communication rates. Terrestrial microwave communications terminals, in one exemplary embodiment, comprise point to point terminals. In another exemplary embodiment, terrestrial microwave communications terminals comprise ground terminals for use in communication with any satellite, such as a satellite configured to switch frequency range and/or polarity of a RF signal broadcasted. These terrestrial microwave communications terminals are spot beam based systems.

In accordance with various exemplary embodiments, a satellite configured to communicate one or more RF signal beams each associated with a spot and/or color has many benefits in microwave communications systems. For example, similar to what was stated above for exemplary terminals in accordance with various embodiments, doing so may facilitate increased bandwidth, load shifting, roaming, increased data rate/download speeds, improved overall efficiency of a group of users on the system, or improved individual data communication rates. In accordance with another exemplary embodiment, the satellite is configured to remotely switch frequency range and/or polarity of a RF signal broadcasted by the satellite. This has many benefits in microwave communications systems. In another exemplary embodiment, satellites are in communications with any suitable terrestrial microwave communications terminal, such as a terminal having the ability to perform frequency and/or polarization switching.

Prior art spot beam based systems use frequency and polarization diversity to reduce or eliminate interference from adjacent spot beams. This allows frequency reuse in non-adjacent beams resulting in increased satellite capacity and throughput. Unfortunately, in the prior art, in order to have such diversity, installers of such systems must be able to set the correct polarity at installation or carry different polarity versions of the terminal. For example, at an installation site, an installer might carry a first terminal configured for left hand polarization and a second terminal configured for right hand polarization and use the first terminal in one geographic area and the second terminal in another geographic area. Alternatively, the installer might be able to disassemble and reassemble a terminal to switch it from one polarization to another polarization. This might be done, for example, by removing the polarizer, rotating it 90 degrees, and reinstalling the polarizer in this new orientation. These prior art solutions are cumbersome in that it is not desirable to have to carry a variety of components at the installation site. Also, the manual disassembly/reassembly steps introduce the possibility of human error and/or defects.

These prior art solutions, moreover, for all practical purposes, permanently set the frequency range and polarization for a particular terminal. This is so because any change to the frequency range and polarization will involve the time and expense of a service call. An installer would have to visit the physical location and change the polarization either by using the disassembly/re-assembly technique or by just switching out the entire terminal. In the consumer broadband satellite terminal market, the cost of the service call can exceed the cost of the equipment and in general manually changing polarity in such terminals is economically unfeasible.

In accordance with various exemplary embodiments, a low cost system and method for electronically or electro-mechanically switching frequency ranges and/or polarity is provided. In an exemplary embodiment, the frequency range and/or polarization of a terminal can be changed without a human touching the terminal. Stated another way, the frequency range and/or polarization of a terminal can be changed without a service call. In an exemplary embodiment, the system is configured to remotely cause the frequency range and/or polarity of the terminal to change.

In one exemplary embodiment, the system and method facilitate installing a single type of terminal that is capable of being electronically set to a desired frequency range from among two or more frequency ranges. Some exemplary frequency ranges include receiving 10.7 GHz to 12.75 GHz, transmitting 13.75 GHz to 14.5 GHz, receiving 18.3 GHz to 20.2 GHz, and transmitting 28.1 GHz to 30.0 GHz. Furthermore, other desired frequency ranges of a point-to-point system fall within 15 GHz to 38 GHz. In another exemplary embodiment, the system and method facilitate installing a single type of terminal that is capable of being electronically set to a desired polarity from among two or more polarities. The polarities may comprise, for example, left hand circular, right hand circular, vertical linear, horizontal linear, or any other orthogonal polarization. Moreover, in various exemplary embodiments, a single type of terminal may be installed that is capable of electronically selecting both the frequency range and the polarity of the terminal from among choices of frequency range and polarity, respectively.

In an exemplary embodiment, transmit and receive signals are paired so that a common switching mechanism switches both signals simultaneously. For example, one "color" may be a receive signal in the frequency range of 19.7 GHz to 20.2 GHz using RHCP, and a transmit signal in the frequency range of 29.5 GHz to 30.0 GHz using LHCP. Another "color" may use the same frequency ranges but transmit using RHCP and receive using LHCP. Accordingly, in an exemplary embodiment, transmit and receive signals are operated at opposite polarizations. However, in some exemplary embodiments, transmit and receive signals are operated on the same polarization which increases the signal isolation requirements for self-interference free operation.

Thus, a single terminal type may be installed that can be configured in a first manner for a first geographical area and in a second manner for a second geographical area that is different from the first area, where the first geographical area uses a first color and the second geographical area uses a second color different from the first color.

In accordance with an exemplary embodiment, a terminal, such as a terrestrial microwave communications terminal, may be configured to facilitate load balancing. In accordance with another exemplary embodiment, a satellite may be configured to facilitate load balancing. Load balancing involves moving some of the load on a particular satellite, or point-to-point system, from one polarity/frequency range "color" or "beam" to another. In an exemplary embodiment, the load balancing is enabled by the ability to remotely switch frequency range and/or polarity of either the terminal or the satellite.

Thus, in exemplary embodiments, a method of load balancing comprises the steps of remotely switching frequency range and/or polarity of one or more terrestrial microwave communications terminals. For example, system operators or load monitoring computers may determine that dynamic changes in system bandwidth resources has created a situation where it would be advantageous to move certain users to adjacent beams that may be less congested. In one example, those users may be moved back at a later time as the loading changes again. In an exemplary embodiment, this signal switching (and therefore this satellite capacity "load balancing") can be performed periodically. In other exemplary embodiments, load balancing can be performed on many terminals (e.g., hundreds or thousands of terminals) simultaneously or substantially simultaneously. In other exemplary embodiments, load balancing can be performed on many terminals without the need for thousands of user terminals to be manually reconfigured.

In one exemplary embodiment, dynamic control of signal polarization is implemented for secure communications by utilizing polarization hopping. Communication security can be enhanced by changing the polarization of a communications signal at a rate known to other authorized users. An unauthorized user will not know the correct polarization for any given instant and if using a constant polarization, the unauthorized user would only have the correct polarization for brief instances in time. A similar application to polarization hopping for secure communications is to use polarization hopping for signal scanning. In other words, the polarization of the antenna can be continuously adjusted to monitor for signal detection.

In an exemplary embodiment, the load balancing is performed as frequently as necessary based on system loading. For example, load balancing could be done on a seasonal basis. For example, loads may change significantly when schools, colleges, and the like start and end their sessions. As another example, vacation seasons may give rise to significant load variations. For example, a particular geographic area may have a very high load of data traffic. This may be due to a higher than average population density in that area, a higher than average number of transceivers in that area, or a higher than average usage of data transmission in that area. In another example, load balancing is performed on an hourly basis. Furthermore, load balancing could be performed at any suitable time. In one example, if maximum usage is between 6-7 PM then some of the users in the heaviest loaded beam areas could be switched to adjacent beams in a different time zone. In another example, if a geographic area comprises both office and home terminals, and the office terminals experience heaviest loads at different times than the home terminals, the load balancing may be performed between home and office terminals. In yet another embodiment, a particular area may have increased localized signal transmission traffic, such as related to high traffic within businesses, scientific research activities, graphic/video intensive entertainment data transmissions, a sporting event or a convention. Stated another way, in an exemplary embodiment, load balancing may be performed by switching the color of any subgroup(s) of a group of transceivers.

In an exemplary embodiment, the consumer broadband terrestrial terminal is configured to determine, based on preprogrammed instructions, what colors are available and switch to another color of operation. For example, the terrestrial terminal may have visibility to two or more beams (each of a different color). The terrestrial terminal may determine which of the two or more beams is better to connect to. This determination may be made based on any suitable factor. In one exemplary embodiment, the determination of which color to use is based on the data rate, the download speed, and/or the capacity on the beam associated with that color. In other exemplary embodiments, the determination is made randomly, or in any other suitable way.

This technique is useful in a geographically stationary embodiment because loads change over both short and long periods of time for a variety of reasons and such self adjusting of color selection facilitates load balancing. This technique is also useful in mobile satellite communication as a form of "roaming". For example, in one exemplary embodiment, the broadband terrestrial terminal is configured to switch to another color of operation based on signal strength. This is, in contrast to traditional cell phone type roaming, where that roaming determination is based on signal strength. In contrast, here, the color distribution is based on capacity in the channel. Thus, in an exemplary embodiment, the determination of which color to use may be made to optimize communication speed as the terminal moves from one spot to another. Alternatively, in an exemplary embodiment, a color signal broadcast by the satellite may change or the spot beam may be moved and still, the broadband terrestrial terminal may be configured to automatically adjust to communicate on a different color (based, for example, on channel capacity).

Figure 7A:
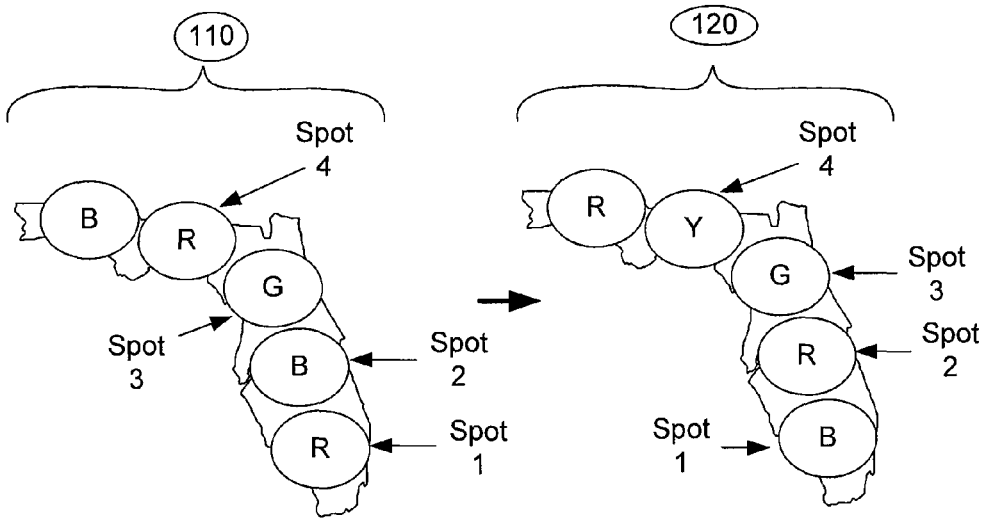
FIGS. 7A-7C illustrate various satellite spot beam multi-color agility methods, in accordance with exemplary embodiments.

In accordance with another exemplary embodiment, a satellite is configured to communicate one or more RF signal beams each associated with a spot and/or color. In accordance with another exemplary embodiment, the satellite is configured to remotely switch frequency range and/or polarity of a RF signal broadcasted by the satellite. In another exemplary embodiment, a satellite may be configured to broadcast additional colors. For example, an area and/or a satellite might only have 4 colors at a first time, but two additional colors, (making 6 total colors) might be dynamically added at a second time. In this event, it may be desirable to change the color of a particular spot to one of the new colors. With reference to FIG. 7A, spot 4 changes from "red" to then new color "yellow". In one exemplary embodiment, the ability to add colors may be a function of the system's ability to operate, both transmit and/or receive over a wide bandwidth within one device and to tune the frequency of that device over that wide bandwidth.

In accordance with an exemplary embodiment, and with renewed reference to FIG. 3, a satellite may have a downlink, an uplink, and a coverage area. The coverage area may be comprised of smaller regions each corresponding to a spot beam to illuminate the respective region. Spot beams may be adjacent to one another and have overlapping regions. A satellite communications system has many parameters to work: (1) number of orthogonal time or frequency slots (defined as color patterns hereafter); (2) beam spacing (characterized by the beam roll-off at the cross-over point); (3) frequency re-use patterns (the re-use patterns can be regular in structures, where a uniformly distributed capacity is required); and (4) numbers of beams (a satellite with more beams will provide more system flexibility and better bandwidth efficiency). Polarization may be used as a quantity to define a re-use pattern in addition to time or frequency slots. In one exemplary embodiment, the spot beams may comprise a first spot beam and a second spot beam. The first spot beam may illuminate a first region within a geographic area, in order to send information to a first plurality of subscriber terminals. The second spot beam may illuminate a second region within the geographic area and adjacent to the first region, in order to send information to a second plurality of subscriber terminals. The first and second regions may overlap.

The first spot beam may have a first characteristic polarization. The second spot beam may have a second characteristic polarization that is orthogonal to the first polarization. The polarization orthogonality serves to provide an isolation quantity between adjacent beams. Polarization may be combined with frequency slots to achieve a higher degree of isolation between adjacent beams and their respective coverage areas. The subscriber terminals in the first beam may have a polarization that matches the first characteristic polarization. The subscriber terminals in the second beam may have a polarization that matches the second characteristic polarization.

The subscriber terminals in the overlap region of the adjacent beams may be optionally assigned to the first beam or to the second beam. This optional assignment is a flexibility within the satellite system and may be altered through reassignment following the start of service for any subscriber terminals within the overlapping region. The ability to remotely change the polarization of a subscriber terminal in an overlapping region illuminated by adjacent spot beams is an important improvement in the operation and optimization of the use of the satellite resources for changing subscriber distributions and quantities. For example it may be an efficient use of satellite resources and improvement to the individual subscriber service to reassign a user or a group of users from a first beam to a second beam or from a second beam to a first beam. Satellite systems using polarization as a quantity to provide isolation between adjacent beams may thus be configured to change the polarization remotely by sending a signal containing a command to switch or change the polarization from a first polarization state to a second orthogonal polarization state. The intentional changing of the polarization may facilitate reassignment to an adjacent beam in a spot beam satellite system using polarization for increasing a beam isolation quantity.

The down link may comprise multiple "colors" based on combinations of selected frequency and/or polarizations. Although other frequencies and frequency ranges may be used, and other polarizations as well, an example is provided of one multicolor embodiment. For example, and with renewed reference to FIG. 3, in the downlink, colors U1, U3, and U5 are Left-Hand Circular Polarized ("LHCP") and colors U2, U4, and U6 are Right-Hand Circular Polarized ("RHCP"). In the frequency domain, colors U3 and U4 are from 18.3-18.8 GHz; U5 and U6 are from 18.8-19.3 GHz; and U1 and U2 are from 19.7-20.2 GHz. It will be noted that in this exemplary embodiment, each color represents a 500 MHz frequency range. Other frequency ranges may be used in other exemplary embodiments. Thus, selecting one of LHCP or RHCP and designating a frequency band from among the options available will specify a color. Similarly, the uplink comprises frequency/polarization combinations that can be each designated as a color. Often, the LHCP and RHCP are reversed as illustrated, providing increased signal isolation, but this is not necessary. In the uplink, colors U1, U3, and U5 are RHCP and colors U2, U4, and U6 are LHCP. In the frequency domain, colors U3 and U4 are from 28.1-28.6 GHz; U5 and U6 are from 28.6-29.1 GHz; and U1 and U2 are from 29.5-30.0 GHz. It will be noted that in this exemplary embodiment, each color similarly represents a 500 MHz frequency range.

In an exemplary embodiment, the satellite may broadcast one or more RF signal beam (spot beam) associated with a spot and a color. This satellite is further configured to change the color of the spot from a first color to a second, different, color. Thus, with renewed reference to FIG. 7A, spot 1 is changed from "red" to "blue".

When the color of one spot is changed, it may be desirable to change the colors of adjacent spots as well. Again with reference to FIG. 7A, the map shows a group of spot colors at a first point in time, where this group at this time is designated 110, and a copy of the map shows a group of spot colors at a second point in time, designated 120. Some or all of the colors may change between the first point in time and the second point in time. For example spot 1 changes from red to blue and spot 2 changes from blue to red. Spot 3, however, stays the same. In this manner, in an exemplary embodiment, adjacent spots are not identical colors.

Some of the spot beams are of one color and others are of a different color. For signal separation, the spot beams of similar color are typically not located adjacent to each other. In an exemplary embodiment, and with reference again to FIG. 3, the distribution pattern illustrated provides one exemplary layout pattern for four color spot beam frequency reuse. It should be recognized that with this pattern, color U1 will not be next to another color U1, etc. It should be noted, however, that typically the spot beams will over lap and that the spot beams may be better represented with circular areas of coverage. Furthermore, it should be appreciated that the strength of the signal may decrease with distance from the center of the circle, so that the circle is only an approximation of the coverage of the particular spot beam. The circular areas of coverage may be overlaid on a map to determine what spot beam(s) are available in a particular area.

In accordance with an exemplary embodiment, the satellite is configured to shift one or more spots from a first geographic location to a second geographic location. This may be described as shifting the center of the spot from a first location to a second location. This might also be described as changing the effective size (e.g. diameter) of the spot. In accordance with an exemplary embodiment, the satellite is configured to shift the center of the spot from a first location to a second location and/or change the effective size of one or more spots. In the prior art, it would be unthinkable to shift a spot because such an action would strand terrestrial transceivers. The terrestrial transceivers would be stranded because the shifting of one or more spots would leave some terrestrial terminals unable to communicate with a new spot of a different color.

However, in an exemplary embodiment, the transceivers are configured to easily switch colors. Thus, in an exemplary method, the geographic location of one or more spots is shifted and the color of the terrestrial transceivers may be adjusted as needed.

Figure 7B:
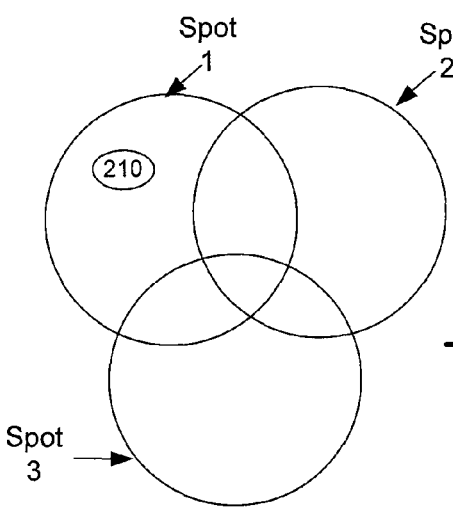
Figure 7C:
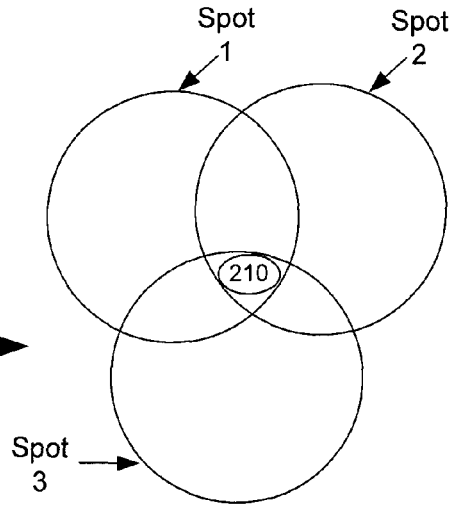

In an exemplary embodiment, the spots are shifted such that a high load geographic region is covered by two or more overlapping spots. For example, with reference to FIGS. 7B and 7C, a particular geographic area 210 may have a very high load of data traffic. In this exemplary embodiment, area 210 is only served by spot 1 at a first point in time illustrated by FIG. 7B. At a second point in time illustrated by FIG. 7C, the spots have been shifted such that area 210 is now served or covered by spots 1, 2, and 3. In this embodiment, terrestrial transceivers in area 210 may be adjusted such that some of the transceivers are served by spot 1, others by spot 2, and yet others by spot 3. In other words, transceivers in area 210 may be selectively assigned one of three colors. In this manner, the load in this area can be shared or load-balanced.

In an exemplary embodiment, the switching of the satellites and/or terminals may occur with any regularity. For example, the polarization may be switched during the evening hours, and then switched back during business hours to reflect transmission load variations that occur over time. In an exemplary embodiment, the polarization may be switched thousands of times during the life of elements in the system.

In one exemplary embodiment, the color of the terminal is not determined or assigned until installation of the terrestrial transceiver. This is in contrast to units shipped from the factory set as one particular color. The ability to ship a terrestrial transceiver without concern for its "color" facilitates simpler inventory processes, as only one unit (as opposed to two or four or more) need be stored. In an exemplary embodiment, the terminal is installed, and then the color is set in an automated manner (i.e. the technician can't make a human error) either manually or electronically. In another exemplary embodiment, the color is set remotely such as being assigned by a remote central control center. In another exemplary embodiment, the unit itself determines the best color and operates at that color.

As can be noted, the determination of what color to use for a particular terminal may be based on any number of factors. The color may based on what signal is strongest, based on relative bandwidth available between available colors, randomly assigned among available colors, based on geographic considerations, based on temporal considerations (such as weather, bandwidth usage, events, work patterns, days of the week, sporting events, and/or the like), and or the like. Previously, a terrestrial consumer broadband terminal was not capable of determining what color to use based on conditions at the moment of install or quickly, remotely varied during use.

In accordance with an exemplary embodiment, the system is configured to facilitate remote addressability of subscriber terminals. In one exemplary embodiment, the system is configured to remotely address a specific terminal. The system may be configured to address each subscriber terminal. In another exemplary embodiment, a group of subscriber terminals may be addressable. This may occur using any number of methods now known, or hereafter invented, to communicate instructions with a specific transceiver and/or group of subscriber terminals. Thus, a remote signal may command a terminal or group of terminals to switch from one color to another color. The terminals may be addressable in any suitable manner. In one exemplary embodiment, an IP address is associated with each terminal. In an exemplary embodiment, the terminals may be addressable through the modems or set top boxes (e.g. via the internet). Thus, in accordance with an exemplary embodiment, the system is configured for remotely changing a characteristic polarization of a subscriber terminal by sending a command addressed to a particular terminal. This may facilitate load balancing and the like. The sub-group could be a geographic sub group within a larger geographic area, or any other group formed on any suitable basis In this manner, an individual unit may be controlled on a one to one basis. Similarly, all of the units in a sub-group may be commanded to change colors at the same time. In one embodiment, a group is broken into small sub-groups (e.g., 100 sub groups each comprising 1% of the terminals in the larger grouping). Other sub-groups might comprise 5%, 10%, 20%, 35%, 50% of the terminals, and the like. The granularity of the subgroups may facilitate more fine tuning in the load balancing.

Thus, an individual with a four color switchable transceiver that is located at location A on the map (see FIG. 3, Practical Distribution Illustration), would have available to them colors U1, U2, and U3. The transceiver could be switched to operate on one of those three colors as best suits the needs at the time. Likewise, location B on the map would have colors U1 and U3 available. Lastly, location C on the map would have color U1 available. In many practical circumstances, a transceiver will have two or three color options available in a particular area.

It should be noted that colors U5 and U6 might also be used and further increase the options of colors to use in a spot beam pattern. This may also further increase the options available to a particular transceiver in a particular location. Although described as a four or six color embodiment, any suitable number of colors may be used for color switching as described herein. Also, although described herein as a satellite, it is intended that the description is valid for other similar remote communication systems that are configured to communicate with the transceiver.

The frequency range/polarization of the terminal may be selected at least one of remotely, locally, manually, or some combination thereof In one exemplary embodiment, the terminal is configured to be remotely controlled to switch from one frequency range/polarization to another. For example, the terminal may receive a signal from a central system that controls switching the frequency range/polarization. The central system may determine that load changes have significantly slowed down the left hand polarized channel, but that the right hand polarized channel has available bandwidth. The central system could then remotely switch the polarization of a number of terminals. This would improve channel availability for switched and non-switched users alike. Moreover, the units to switch may be selected based on geography, weather, use characteristics, individual bandwidth requirements, and/or other considerations. Furthermore, the switching of frequency range/polarization could be in response to the customer calling the company about poor transmission quality.

It should be noted that although described herein in the context of switching both frequency range and polarization, benefits and advantages similar to those discussed herein may be realized when switching just one of frequency or polarization.

The frequency range switching described herein may be performed in any number of ways. In an exemplary embodiment, the frequency range switching is performed electronically. For example, the frequency range switching may be implemented by adjusting phase shifters in a phased array, switching between fixed frequency oscillators or converters, and/or using a tunable dual conversion transmitter comprising a tunable oscillator signal. Additional aspects of frequency switching for use with the present invention are disclosed in U.S. application Ser. No. 12/614,293 entitled "DUAL CONVERSION TRANSMITTER WITH SINGLE LOCAL OSCILLATOR" which was filed on Nov. 6, 2009; the contents of which are hereby incorporated by reference in their entirety.

In accordance with another exemplary embodiment, the polarization switching described herein may be performed in any number of ways. In an exemplary embodiment, the polarization switching is performed electronically by adjusting the relative phase of signals at orthogonal antenna ports. In another exemplary embodiment, the polarization switching is performed mechanically. For example, the polarization switching may be implemented by use of a trumpet switch. The trumpet switch may be actuated electronically. For example, the trumpet switch may be actuated by electronic magnet, servo, an inductor, a solenoid, a spring, a motor, an electro-mechanical device, or any combination thereof. Moreover, the switching mechanism can be any mechanism configured to move and maintain the position of trumpet switch. Furthermore, in an exemplary embodiment, trumpet switch is held in position by a latching mechanism. The latching mechanism, for example, may be fixed magnets. The latching mechanism keeps trumpet switch in place until the antenna is switched to another polarization.

As described herein, the terminal may be configured to receive a signal causing switching and the signal may be from a remote source. For example, the remote source may be a central office. In another example, an installer or customer can switch the polarization using a local computer connected to the terminal which sends commands to the switch. In another embodiment, an installer or customer can switch the polarization using the television set-top box which in turn sends signals to the switch. The polarization switching may occur during installation, as a means to increase performance, or as another option for troubleshooting poor performance.

In other exemplary embodiments, manual methods may be used to change a terminal from one polarization to another. This can be accomplished by physically moving a switch within the housing of the system or by extending the switch outside the housing to make it easier to manually switch the polarization. This could be done by either an installer or customer.

Some exemplary embodiments of the above mentioned multi-color embodiments may benefits over the prior art. For instance, in an exemplary embodiment, a low cost consumer broadband terrestrial terminal antenna system may include an antenna, a transceiver in signal communication with the antenna, and a polarity switch configured to cause the antenna system to switch between a first polarity and a second polarity. In this exemplary embodiment, the antenna system may be configured to operate at the first polarity and/or the second polarity.

In an exemplary embodiment, a method of system resource load balancing is disclosed. In this exemplary embodiment, the method may include the steps of: (1) determining that load on a first spotbeam is higher than a desired level and that load on a second spotbeam is low enough to accommodate additional load; (2) identifying, as available for switching, consumer broadband terrestrial terminals on the first spot beam that are in view of the second spotbeam; (3) sending a remote command to the available for switching terminals; and (4) switching color in said terminals from the first beam to the second beam based on the remote command. In this exemplary embodiment, the first and second spot beams are each a different color.

In an exemplary embodiment, a satellite communication system is disclosed. In this exemplary embodiment, the satellite communication system may include: a satellite configured to broadcast multiple spotbeams; a plurality of user terminal antenna systems in various geographic locations; and a remote system controller configured to command at least some of the subset of the plurality of user terminal antenna systems to switch at least one of a polarity and a frequency to switch from the first spot beam to the second spotbeam. In this exemplary embodiment, the multiple spot beams may include at least a first spotbeam of a first color and a second spotbeam of a second color. In this exemplary embodiment, at least a subset of the plurality of user terminal antenna systems may be located within view of both the first and second spotbeams.

Figures 4A, 4B:
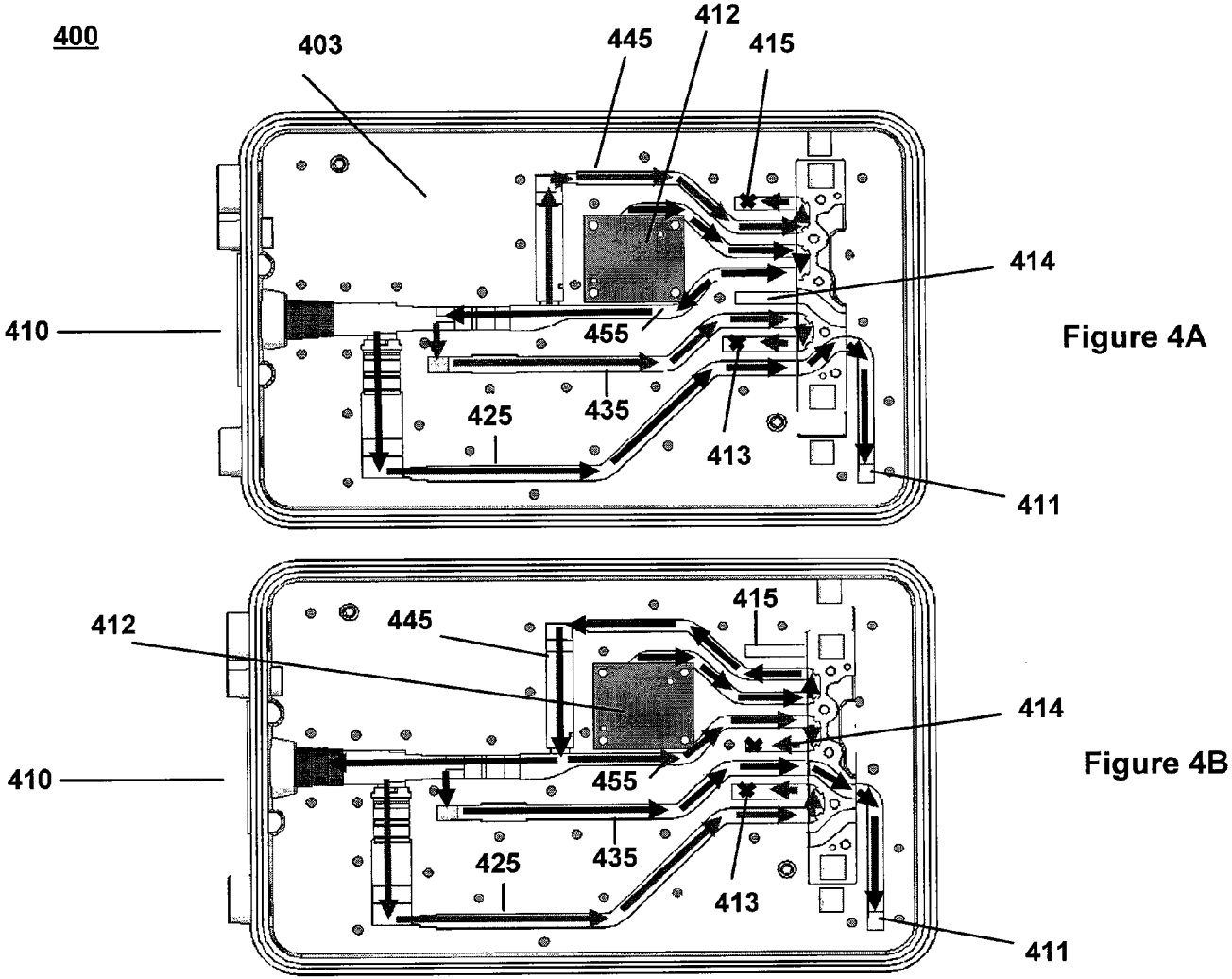
FIGS. 4A and 4B illustrate an exemplary antenna system with alternate signal paths due to polarization switching.
Figure 4C:
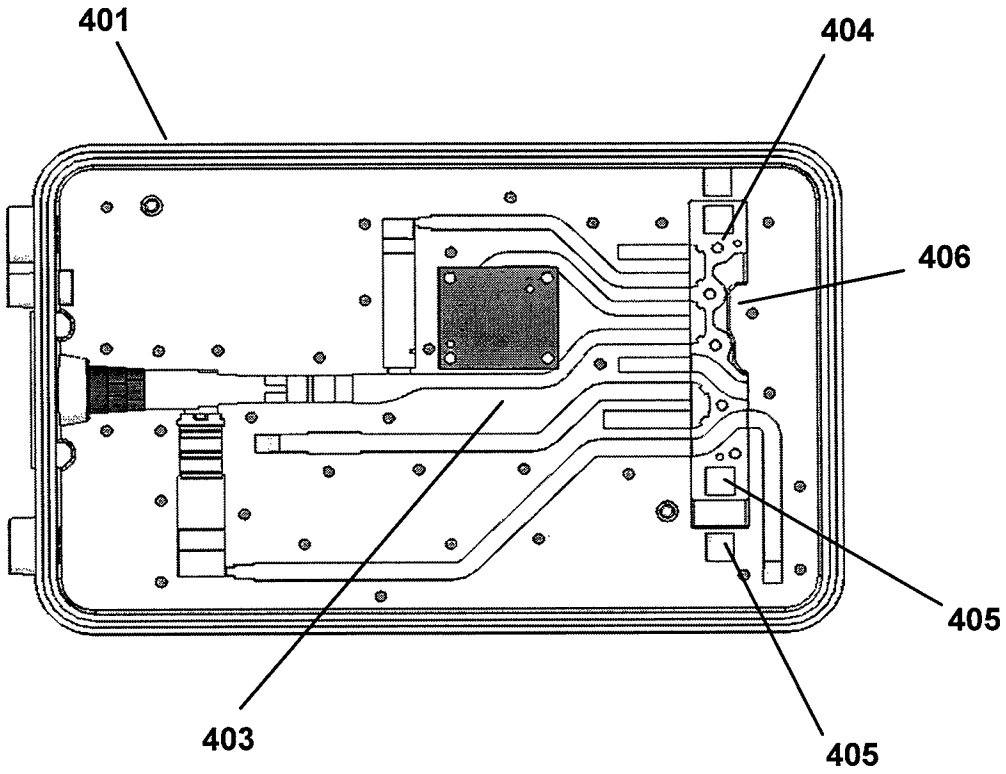
FIG. 4C illustrates an exemplary embodiment of an antenna system with a sliding switch.

In an exemplary embodiment and with reference to FIGS. 4A, 4B, and 4C a transceiver housing 401 comprises a waveguide 403. Transceiver housing 401 further comprises a sliding switch 404. In an exemplary embodiment, sliding switch 404 moves in a linear direction in order to change the polarization of an antenna system 400. In an exemplary embodiment, sliding switch 404 is a trumpet valve. The trumpet valve comprises alternate signal channels through the switch. The alternate signal channels are aligned with different polarization channels in waveguide 404. For example, a first signal channel can align the antenna with RHCP, while a second signal channel can align the antenna with LHCP. By shifting the position of sliding switch 404, the polarization of antenna system 400 is physically changed. Alternatively, a first signal channel can align the antenna with RHCP, while a second signal channel also aligns the antenna with RHCP. By shifting the position of sliding switch 404, the polarization of antenna system 400 is physically changed so that the first signal channel can align the antenna with LHCP, and the second signal channel can align the antenna with LHCP. The alternative is also true. For example, a first signal channel can align the antenna with LHCP, while a second signal channel also aligns the antenna with LHCP. By shifting the position of sliding switch 404, the polarization of antenna system 400 is physically changed so that the first signal channel can align the antenna with RHCP, and the second signal channel can align the antenna with RHCP.

In an exemplary embodiment and with reference to FIGS. 4A and 4B, waveguide 403 comprises a common port 410, a first signal channel 425, a second signal channel 435, a third signal channel 445, and a fourth signal channel 455. Each of these channels is connected to common port 410. In an exemplary embodiment, waveguide 403 further comprises five signal ports: a receive active port 411, a transmit active port 412, a receive termination port/load 413, a first transmit termination port/load 414, and a second transmit termination port/load 415. In an exemplary embodiment, linear switch 404 is configured to control the connection between signal channels 425, 435, 445, 455 and several of signal ports 411, 412, 413, 414, 415.

In accordance with an exemplary embodiment, FIG. 4A illustrates the signal channels if sliding switch 404 is in one position, and FIG. 4B illustrates the signal channels if sliding switch 404 is in another position. In the exemplary configuration illustrated by FIG. 4A, first signal channel 425 is connected to receive active port 411, second signal channel 435 is terminated into receive termination port/load 413, third signal channel 445 is terminated into second termination port/load 415, and fourth signal channel 455 is connected to transmit active port 412. In contrast, in the exemplary configuration illustrated by FIG. 4B, first signal channel 425 is terminated into receive termination port/load 413, second signal channel 435 is connected to receive active port 411, third signal channel 445 is connected to transmit active port 412, and fourth signal channel 455 is terminated into first termination port/load 414.

In accordance with an exemplary embodiment and with reference again to FIG. 4C, sliding switch 404 is made of metalized plastic. Metalized plastic is lighter weight and less expensive than metal. Furthermore, a lighter weight sliding switch needs less force to change position. In an exemplary embodiment, the waveguide portions present in sliding switch 404 are short and thus result in minimal RF loss. In one embodiment, the waveguide portions of sliding switch 404 do not include additional features. However, in exemplary embodiments the short waveguide portions in sliding switch 404 may include RF loads, filters, or impedance matching structures. This can result in increased antenna performance and additional compactness of the waveguide.

The position of sliding switch 404, in an exemplary embodiment, is controlled by a microcontroller. As previously discussed, the microcontroller can receive instructions from a variety of sources, including a central controller, local computer, a modem, or a local switch. Furthermore, various other devices and methods of controlling sliding switch 404 may be implemented as would be known to one skilled in the art.

Furthermore, in an exemplary embodiment, sliding switch 404 further comprises a sliding key 406. Sliding key 406 is configured to prevent errors during manufacturing, such as by not allowing sliding switch 404 to be assembled backwards.

Figure 5:
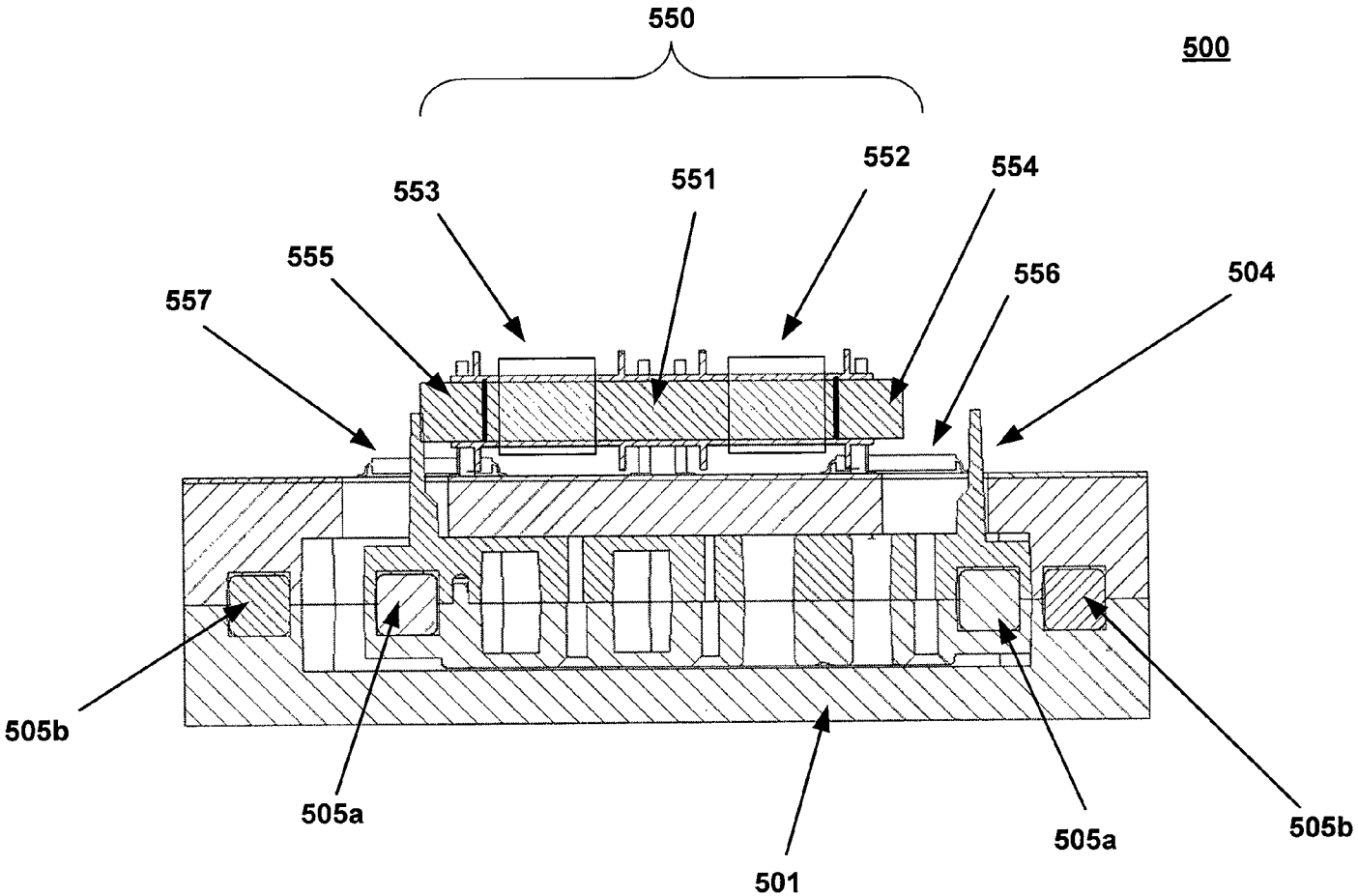
FIG. 5 illustrates a cross-sectional view of an exemplary antenna system with sliding switch and switching mechanism.

In accordance with an exemplary embodiment and with reference to FIG. 5 an antenna system 500 comprises a transceiver housing 501 having a waveguide. In an exemplary embodiment, the waveguide is integrated into a transceiver housing 501. In another embodiment, the waveguide is part of a structure that is "dropped in" to transceiver housing 501. Transceiver housing 501 further comprises a sliding switch 504. In an exemplary embodiment, switching mechanisms are configured to change sliding switch 504 between two different polarizations. In order to shift sliding switch 504, various switching mechanisms may be used. For example, the switching mechanism can include an inductor, an electromagnet, a solenoid, a spring, a motor, an electro-mechanical device, or any combination thereof. Moreover, the switching mechanism can be any mechanism configured to move the position of sliding switch 504.

Furthermore, in an exemplary embodiment, sliding switch 504 is held in position by a latching mechanism 505*a* and 505*b*. The latching mechanism 505*a* and 505*b*, for example, may be fixed magnets 505*a* and metal inserts 505*b* to attach to the magnets. The latching mechanism 505*a* and 505*b* keeps sliding switch 504 in place until the antenna is commanded to another polarization.

In an exemplary embodiment, a solenoid 550 is the switching mechanism used to move sliding switch 504 in a linear path. Solenoid 550 may be made of surface mount inductors. Furthermore, in an exemplary embodiment, solenoid 550 comprises a plunger 551, a first coil 552, a second coil 553, a first standoff 554 connected to a first end of plunger 551, and a second standoff 555 connected to a second end of plunger 551 opposite the first end. In another exemplary embodiment, antenna system 500 further comprises proximity detectors 556, 557.

In an exemplary embodiment, plunger 551 is made of a ferromagnetic alloy and standoffs 554, 555 are non-magnetic. In one embodiment, non-magnetic standoffs 554, 555 are made of aluminum. The non-magnetic standoffs allow for additional force to be applied to the plunger. In an exemplary embodiment, solenoid 550 provides peak force at the moment that it attempts to disengage from one of latching mechanisms 505*a* and 505*b*. The distance that plunger 551 moves contains regions of higher and lower magnetic force, so an exemplary design optimizes the length of travel and length of plunger 551 to take advantage of the region of highest magnetic force. This allows smaller electromagnets to move the same amount of mass and lower current to be used in the electromagnet during switching. Plunger 551 can then push the slider's tabs into either position.

In another exemplary embodiment, proximity detectors 556, 557 enable the system to determine the current polarization based on the position of sliding switch 504. As an example, the proximity detectors may be magnetic such as a reed switch, electrical such as a contact switch, or an optical sensor. Furthermore, in one embodiment only a single proximity detector is implemented. In addition, other various proximity detector methods may be used as would be known to one skilled in the art. In an exemplary embodiment, the detected position of the sliding switch indicates the current routing of the waveguide by correlating the detected position to the current polarization of the waveguide.

Figure 6A:
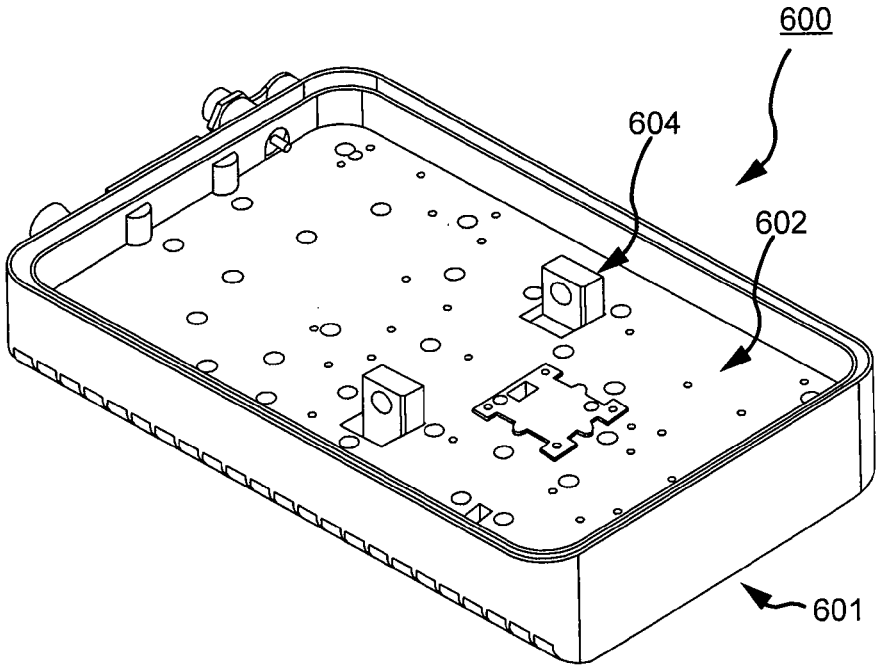
FIGS. 6A and 6B illustrate exemplary views of an antenna system with a sliding switch for facilitating polarization switching.
Figure 6B:
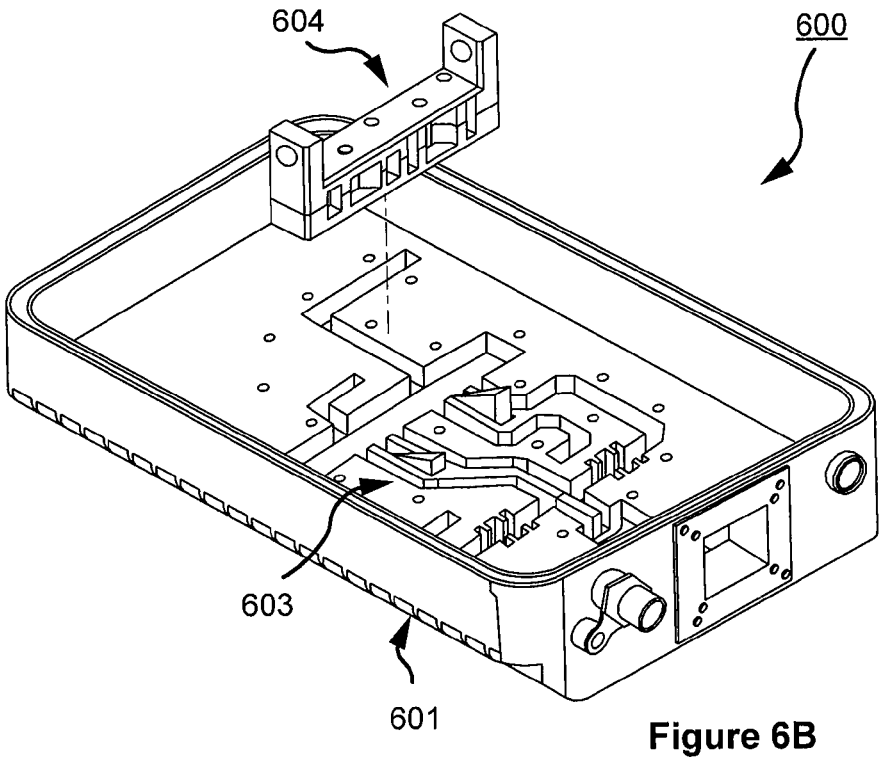
Figure 6C:
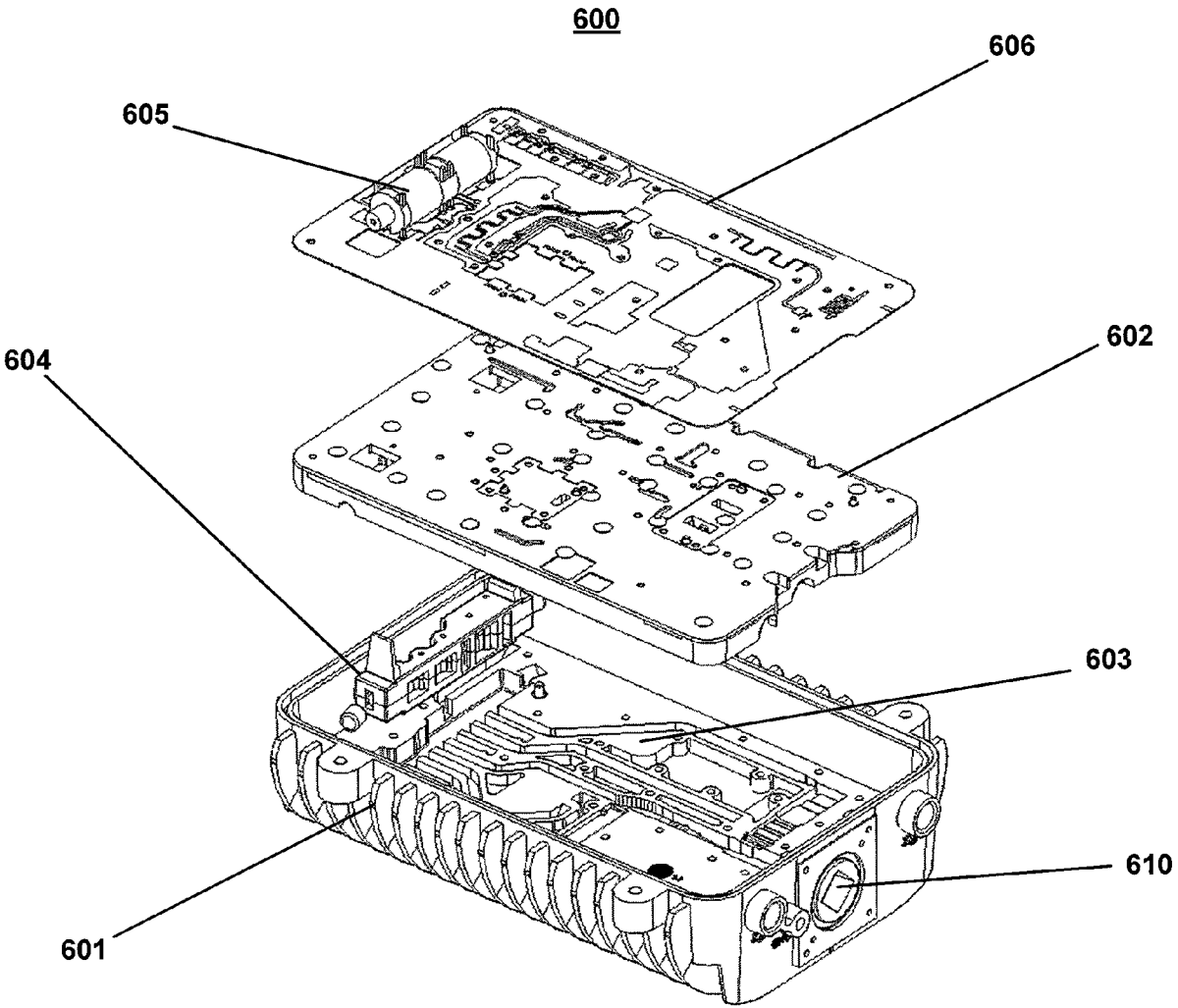
FIG. 6C illustrates an exploded view of an exemplary antenna system with a sliding switch.

In an exemplary embodiment and with reference to FIGS. 6A-6C, an exemplary antenna system 600 comprises a housing 601, a waveguide 603, and a sliding switch 604. In an exemplary embodiment and with reference to FIG. 6C antenna system 600 may further comprise a sub-floor component 602, a printed circuit board 606, and a switching mechanism 605.

In one exemplary embodiment, waveguide 603 is formed as part of housing 601. In this exemplary embodiment, sliding switch 604 is placed in a recess in housing 601. Furthermore, sub-floor component 602 is placed within housing 601 and is configured to cover, and enclose, waveguides 603 as well as sandwiching at least a portion of sliding switch 604. In one embodiment, printed circuit board 606 is located on top of sub-floor 602. In another embodiment, switching mechanism 605 is located on printed wiring board 606.

In one embodiment, housing 601 comprises the outer structure of antenna system 600. Furthermore, in an exemplary embodiment, housing 601 comprises ports of waveguide 603, which includes multiple waveguide channels. In an exemplary embodiment, some of waveguide channels are connected to a common port 610. In one exemplary embodiment, the waveguide paths are integrated into the interior of housing 601. In another exemplary embodiment, the waveguide paths 603 are part of a "drop in" component that inserts into housing 601.

Housing 601, or alternatively the drop-in component, is formed with a recess configured to receive sliding switch 604. This recess may be large enough to facilitate alignment of sliding switch 604 with the appropriate waveguide paths and to facilitate sliding from at least a first position to second position. Additionally, sliding switch 604 may be retained within the recess by sub-floor component 602. Sub-floor component 602 is configured to be placed over at least a portion of the interior surface of housing 601. Alternatively, sub-floor component 602 may be the other half of a drop in component. In an exemplary embodiment, sub-floor component 620 is configured to complete the waveguide paths by forming a top portion of those waveguide paths. Sub-floor component 620 may also be configured to provide openings for a portion of sliding switch 604 to extend far enough for interaction with switching mechanism 605.

In another exemplary embodiment, antenna system 600 further comprises a switching mechanism 605. In another exemplary embodiment, switching mechanism 605 may be mounted on a printed circuit board 606. The integrated waveguide 603 and connected sliding switch 604 are inside housing 601. This facilitates a more compact system and increases protection of components from weather. In this manner, sliding switch 604 is capable of a longer useful life. For example, there is more protection against dirt and other material from entering and disrupting switching mechanism 605.

In an exemplary embodiment, waveguide 603 (typically an OMT) is formed inside the antenna system housing using housing 601 and a sub-floor component 602. Neither housing 601 nor sub-floor component 602 alone is configured to operate as a waveguide. In an exemplary embodiment, a portion of the waveguide is cast into housing 601 and is part of the system housing.

In an exemplary embodiment, a polarizer and feed horn are still external to the antenna system housing. In another exemplary embodiment, the feed horn is external to the housing and the polarizer is also integrated into the system housing. In yet another exemplary embodiment, both the feed horn and the polarizer are located in the antenna system housing, along with waveguide 603 and sliding switch 604. For additional detail regarding an integrated OMT, please see U.S. patent application Ser. No. 12/268,840, entitled "Integrated OMT", which was filed on Nov. 11, 2008, and U.S. Provisional Patent No. 61/113,517, entitled "Molded Ortho-Mode Transducer", which was filed on Nov. 11, 2008, both of which are herein incorporated by reference.

Although sliding switch 604 has a linear motion in the exemplary embodiments as discussed above, in accordance with another exemplary embodiment a rotary motion switch may also be implemented. It is noted that the physical rotation may occur either inside or outside the housing of the antenna system. Furthermore, the physical rotation is relative motion between the antenna feed and the transceiver. In other words, either at least a portion of the antenna feed, or the transceiver housing may rotate. In an exemplary embodiment, an antenna system comprises a housing, a waveguide integrated into the housing, a polarizer in communication with the waveguide and connected to the housing, and a feed horn connected to the polarizer. In an exemplary embodiment, the polarizer comprises a gear and the antenna system further comprises a gear motor. The polarizer is rotated about a central axis using the gear and gear motor. In one embodiment, a signal is delivered to the antenna system and controls the gear motor rotating the polarizer via the gear.

Furthermore, the described invention is not limited to switching between two different polarizations. In an exemplary embodiment, an antenna system is configured to switch between three or more polarizations. The antenna system may include more than one sliding switch. Additionally, in an exemplary embodiment, a sliding switch is designed to shift vertically and horizontally with respect to the waveguide. The additional movement can be used to incorporate additional waveguide routing, and thus additional polarizations.

In an exemplary embodiment, the sliding switch further includes (1) a first receive signal channel configured to connect to a MMIC when the switch is in the first position, and wherein the first receive signal channel is configured to connect to a terminate when the switch is in a second position; (2) a second receive signal channel configured to connect to the MMIC when the switch is in the second position, and wherein the second receive signal channel is configured to the terminate when the switch is in the first position; (3) a first transmit signal channel configured to connect to the MMIC when the switch is in the first position, and wherein the first transmit signal channel is configured to connect to a terminate when the switch is in the second position; and (4) a second transmit signal channel configured to connect to the MMIC when the switch is in the second position, and wherein the second transmit signal channel is configured to terminate when the switch is in the first position.

In an exemplary embodiment, a low cost user terminal antenna system includes an antenna; a transceiver and a switch causing the transceiver to switch from operating in the first color spotbeam to the second color spotbeam. In this exemplary embodiment, the transceiver may be configured to operate in at least a first color spotbeam and a second color spotbeam. In an exemplary embodiment, the switch may be controlled at least one of remotely commanded via a central system, remotely via a local computer, or manually. In an exemplary embodiment, the switch is commanded electronically. In an exemplary embodiment, the first color comprises a first frequency range and a first polarization, and the second color comprises at least one of a different frequency range from the first frequency range and a different polarization from the first polarization.

In an exemplary embodiment, the first frequency range is at least one of: from about 10.7 GHz to about 12.75 GHz, from about 13.75 GHz to about 14.5 GHz, from about 18.3 GHz to about 20.2 GHz, and from about 28.1 GHz to about 30.0 GHz; and the second frequency range is at least one of: from 10.7 GHz to about 12.75 GHz, from about 13.75 GHz to about 14.5 GHz, from about 18.3 GHz to about 20.2 GHz, and from about 28.1 GHz to about 30.0 GHz. In an exemplary embodiment, the first frequency range spans about 500 Mhz. Additionally, in this exemplary embodiment, the second frequency range spans about 500 Mhz and may be different from the first frequency range.

In an exemplary embodiment, the first polarization is at least one of vertical, horizontal, left hand circular, right hand circular, left hand elliptical and right hand elliptical. In this exemplary embodiment, the second polarization is at least one of vertical, horizontal, left hand circular, right hand circular, left hand elliptical and right hand elliptical. In an exemplary embodiment, the antenna includes a phased array antenna.

In an exemplary embodiment, the first color comprises a first frequency range and a first polarization, and wherein said second color comprises both a different frequency range from the first frequency range and a different polarization from the first polarization. In an exemplary embodiment, the antenna further comprises a feedhorn and an OMT, wherein the OMT comprises a physical switch capable of being commanded remotely and configured to facilitate switching from a first polarity to a second polarity and a first frequency to a second frequency. In an exemplary embodiment, at least one of the polarization switching and frequency switching is electronically effected. In an exemplary embodiment, a low cost user terminal antenna system is provided including: an antenna; a transceiver in signal communication with the antenna, and a polarity switch configured to cause the antenna system to switch operating between the first polarity and the second polarity. In this exemplary embodiment, the antenna system is configured to operate at a first polarity or a second polarity.

In an exemplary embodiment, a method for load balancing in a consumer broadband satellite communications system is provided. In this exemplary embodiment, the system includes (1) operating the low cost consumer broadband user terminal antenna in a first color; (2) receiving a command to change to different color; and (3) switching the low cost consumer broadband user terminal antenna to operate in a second color. In this exemplary embodiment, the command is an electronic command from a location remote from the terminal antenna system.

In an exemplary embodiment, a method of system resource load balancing is disclosed. In this exemplary embodiment the system includes the steps of: (1) determining that load on a first spotbeam is higher than a desired level and that load on a second spotbeam is low enough to accommodate additional load, wherein the first and second spot beams are each a different color; (2) identifying, as available for switching, terminals on the first spot beam that are in view of the second spotbeam; (3) sending a remote command to the available for switching terminals; and (4) switching color from the first beam to the second beam based on the remote command.

In an exemplary embodiment, a satellite communication system including a satellite configured to broadcast multiple spotbeams, a plurality of user terminal antenna systems in various geographic locations, wherein at least a subset of the plurality of user terminal antenna systems are located within view of both the first and second spotbeams; and a remote system controller configured to command at least some of the subset of the plurality of user terminal antenna systems to switch at least one of a polarity and a frequency to switch from the first spot beam to the second spotbeam is disclosed.

In an exemplary embodiment, the multiple spot beams comprise at least a first spotbeam of a first color and a second spotbeam of a second color. In this exemplary embodiment, the remote system controller is configured to command at least some of the subset of the plurality of user terminal antenna systems to switch at least one of a polarity and a frequency to switch from the first spot beam to the second spotbeam in response to programming. In this exemplary embodiment, the remote system controller is configured to command at least some of the subset of the plurality of user terminal antenna systems to switch at least one of a polarity and a frequency to switch from the first spot beam to the second spotbeam as a function of a pre-selected time value.

In an exemplary embodiment, a method of operating a low cost user terminal antenna system including the steps of: (1) operating the user terminal antenna system in a first polarity, (2) switching polarity; and (3) sensing the polarity that is currently active. In an exemplary embodiment, a proximity detector is configured to determine the polarization of the antenna system.

In the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. However, coupled may also mean that two or more elements may not be in direct contact with each other, but yet may still cooperate and/or interact with each other. Furthermore, couple may mean that two objects are in communication with each other, and/or communicate with each other, such as two pieces of hardware. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

It should be appreciated that the particular implementations shown and described herein are illustrative of various embodiments including its best mode, and are not intended to limit the scope of the present disclosure in any way. For the sake of brevity, conventional techniques for signal processing, data transmission, signaling, and network control, and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical communication system.

The following applications are related to this subject matter: U.S. application Ser. No. 12/614,185, entitled "MOLDED ORTHOMODE TRANSDUCER," which was filed on Nov. 6, 2009; U.S. Provisional Application No. 61/113,517, entitled "MOLDED ORTHOMODE TRANSDUCER," which was filed on Nov. 11, 2008; U.S. Provisional Application No. 61/112,538, entitled "DUAL CONVERSION TRANSMITTER WITH SINGLE LOCAL OSCILLATOR," which was filed on Nov. 7, 2008; U.S. application Ser. No. 12/758,966, entitled "AUTOMATED BEAM PEAKING SATELLITE GROUND TERMINAL," which is being filed contemporaneously herewith; U.S. Application Ser. No. 12/759,059, entitled "MULTI-BEAM ACTIVE PHASED ARRAY ARCHITECTURE," which is being filed contemporaneously herewith; U.S. application Ser. No. 12/758,914, entitled "DUAL-POLARIZED, MULTI-BAND, FULL DUPLEX, INTERLEAVED WAVEGUIDE APERATURE," which is being filed contemporaneously herewith; the contents of which are hereby incorporated by reference for any purpose in their entirety.

While the principles of the disclosure have been shown in embodiments, many modifications of structure, arrangements, proportions, the elements, materials and components, used in practice, which are particularly adapted for a specific environment and operating requirements without departing from the principles and scope of this disclosure. These and other changes or modifications are intended to be included within the scope of the present disclosure and may be expressed in the following claims.

What is claimed is:

1. An antenna system, comprising:

a waveguide having a first transmit channel, a first receive channel, a second transmit channel, and a second receive channel; and a sliding switch connected to the waveguide, wherein the sliding switch is configured to change the polarization of the antenna system by connecting either the first transmit and first receive channels or the second transmit and second receive channels.

2. The antenna system of claim 1, wherein the sliding switch is a trumpet valve switch.

3. The antenna system of claim 1, wherein the antenna system switches between left hand circular polarization and right hand circular polarization.

4. The antenna system of claim 3, wherein a transmit signal and a receive signal of the antenna system maintain operating on different polarizations in response to the switching between left hand circular polarization and right hand circular polarization.

5. The antenna system of claim 1, wherein the antenna system switches between vertical polarization and horizontal polarization.

6. The antenna system of claim 5, wherein the sliding switch is moved using at least one of a surface mount inductor, solenoid, electro-mechanical motion, electro-magnets spring, and motor.

7. The antenna system of claim 6, further comprising a latching mechanism configured to hold the sliding switch in a desired position, and wherein the latching mechanism comprises magnets or springs.

8. The antenna system of claim 1, wherein the sliding switch is controlled at least one of remotely via a central system, via a local computer, or manually.

9. The antenna system of claim 1, further comprising a proximity detector configured to determine the current polarization of the antenna system.

10. The antenna system of claim 1, wherein the waveguide and the sliding switch are integrated into a housing of the antenna system.

11. A method of polarization switching comprising:

operating an antenna system in a first mode having a first polarization;

operating the antenna system in a second mode having a second polarization;

switching between the first mode and the second mode by physically altering the channels of a waveguide of the antenna system using a linear switch; and wherein the first polarization is different from the second polarization.

12. The method of claim 11, further comprising remotely controlling the switching between the first mode and the second mode via a central system.

13. The method of claim 11, further comprising remotely controlling the switching between the first mode and the second mode via a local computer.

14. The method of claim 11, further comprising manually controlling the switching between the first mode and the second mode.

15. The method of claim 11, further comprising determining the current mode of the antenna system using a proximity detector.

16. The method of claim 11, wherein the first polarization is right hand circular polarization and the second polarization is left hand circular polarization.

17. The method of claim 11, wherein the first polarization is vertical polarization and the second polarization is horizontal polarization.

18. A transceiver comprising:

a housing;

an integrated waveguide in the housing;

a sliding switch in the housing and connected to the integrated waveguide;

wherein the sliding switch has a first mode and a second mode, wherein the first mode includes the sliding switch allowing signal communication through a first receive channel and a first transmit channel, and wherein the second mode includes the sliding switch allowing signal communication through a second receive channel and a second transmit channel;

wherein the first mode has a first polarization and the second mode has a second polarization that is different from the first polarization; and wherein the sliding switch changes between the first mode and the second mode using a linear motion.

19. An antenna system, comprising:

a waveguide; and a sliding switch connected to the waveguide, wherein the sliding switch is configured to change the polarization of the antenna system.

20. The antenna system of claim 19, wherein the sliding switch has at least two positions of being connected to the waveguide, and wherein a first position of the sliding switch is configured to allow receiving a receive signal using a first polarization and to terminate receive signals at a second polarization, and wherein the sliding switch is further configured to allow transmitting a transmit signal using the second polarization and to terminate transmit signals at the first polarization.

* * * * *